US005189274A

United States Patent [19]

Yamaguchi et al.

[11] Patent Number: 5,189,274

[45] Date of Patent: Feb. 23, 1993

[54] HEATING METHOD FOR MICROWAVE OVEN HAVING HEAT ELEMENT

[75] Inventors: Hideki Yamaguchi, Yamatokoriyama; Masahiro Nitta, Nara; Katsunori Furukawa, Kashihara, all of Japan

[73] Assignee: Matsushita Electric Industrial Co., Ltd., Osaka, Japan

[21] Appl. No.: 767,694

[22] Filed: Sep. 30, 1991

Related U.S. Application Data

[62] Division of Ser. No. 535,030, Jun. 8, 1990, Pat. No. 5,082,999.

[30] Foreign Application Priority Data

Jun. 13, 1989 [JP] Japan ..... 1-151451
Jun. 14, 1989 [JP] Japan ..... 1-151772

[51] Int. Cl.[5] ..... H05B 6/12

[52] U.S. Cl. ..... 219/10.55 M; 219/10.55 R; 219/10.55 F; 426/241

[58] Field of Search ..... 219/10.55 B, 10.55 E, 219/10.55 F, 10.55 M, 10.55 RT; 426/234, 243, 241

[56] References Cited

U.S. PATENT DOCUMENTS

| | | | |
|---|---|---|---|
| 2,920,174 | 1/1960 | Haagensen | 219/10.55 E |
| 3,196,243 | 7/1965 | Schall | 219/10.55 D |
| 3,920,944 | 11/1975 | Constable | 219/10.55 E |
| 4,019,010 | 4/1977 | Tanaka et al. | 219/10.55 F |
| 4,144,434 | 3/1979 | Chiron et al. | 219/10.55 F |
| 4,223,194 | 9/1980 | Fitzmayer | 219/10.55 F |
| 4,295,027 | 10/1981 | Zushi et al. | 219/10.55 B |
| 4,298,780 | 11/1981 | Suzuki | 219/10.55 B |
| 4,326,112 | 4/1982 | Tanaka et al. | 219/10.55 F |
| 4,345,134 | 8/1982 | Tanaka et al. | 219/10.55 B |
| 4,401,884 | 8/1983 | Kusunoki et al. | 219/492 |
| 4,488,025 | 12/1984 | Tanabe | 219/10.55 B |
| 4,517,431 | 5/1985 | Ueda | 219/10.55 B |
| 4,647,746 | 3/1987 | Eke | 219/10.55 B |
| 4,785,152 | 11/1988 | Hirata et al. | 219/10.55 B |
| 5,082,999 | 1/1992 | Yamaguchi et al. | 219/10.55 B |

*Primary Examiner*—Geoffrey S. Evans
*Assistant Examiner*—Tuan Vinh To
*Attorney, Agent, or Firm*—Wenderoth, Lind & Ponack

[57] ABSTRACT

Disclosed is a high-frequency heating device employing microwave heating by a magnetron and heater heating by a heater sheathed by dielectric material. The heating device is internally provided with a wall structure formed in a device housing and having a heating chamber and a heater compartment defined therein. The heater compartment is open towards the heating chamber in communication therewith. The heating device is further internally provided with a magnetron, fixedly mounted in the housing, for supplying microwaves into the heating chamber, a dielectric heater accommodated in the heater compartment and extending through opposite side walls of the heater compartment, and one or more metallic rods, disposed near the heater and securely mounted on at least one of the side walls of the heater compartment, for unifying an electric field on the heater.

4 Claims, 9 Drawing Sheets

HEATING METHOD FOR MICROWAVE OVEN HAVING HEAT ELEMENT

This application is a divisional application of application Ser. No. 07/535,030, which was filed on Jun. 8, 1990, now U.S. Pat. No. 5,082,999.

BACKGROUND OF THE INVENTION

1. Field of the Invention

The present invention generally relates to a heating device and method for cooking food or the like, and more particularly, to a high-frequency heating device and method for cooking food using microwaves, and to a heater element sheathed by dielectric material, such as a quartz-sheathed element heater or the like.

2. Description of the Prior Art

In some conventional high-frequency heating devices, a hollow choke damper is provided at a location where a pipe-shaped dielectric heater extends through a wall structure of a heating chamber. In some other conventional devices, a small shielding chamber for shielding electric waves is provided outside of the heating chamber. Accordingly, these devices are complicated in construction and have some problems.

In these devices, when heating by the dielectric heater is followed by heating by microwaves or when the former and the latter are alternately performed, a dielectric portion of the heater becomes high in temperature, thereby causing a dielectric loss to become large. Under such conditions, when the microwave heating is performed, a dielectric pipe is partially heated by the microwaves, thus occasionally causing the dielectric pipe to be damaged or heating wires constituting the heater to be cut off.

FIGS. 1 and 2 depict one of the above-described conventional heating devices.

As shown in FIGS. 1 and 2, a door 2 is hingedly connected to a housing of the device, in which a heating chamber 1 is formed. A magnetron 3 securely mounted in the housing emits electric waves into the heating chamber 1 through a waveguide 4 so that food 5 or the like may be heated by electric waves. A pair of hollow choke dampers 6 and 7 are cylindrically formed on opposite side walls of the heating chamber 1. A pipe 8 made of a heat-resistant dielectric such as quarts glass or the like extends through the heating chamber 1 and both the choke dampers 6 and 7. The pipe 8 accommodates a heating wire 9 having opposite ends connected to respective lead wires 10 and 11, which are lead out of the housing so that the heating wire 9 may be supplied with electricity via the lead wires 10 and 11.

FIG. 3 depicts one of the choke dampers 6 and 7.

Each end of the pipe 8 is supported by an insulator 14, and each of the choke dampers 6 and 7 comprises an internal wall 12 and an external wall 13 rigidly secured to each other. A recess defined by the internal and external walls 12 and 13 has a length X approximately equal to odd multiples of a quarter-wavelength $\lambda/4$ of electric waves to be used, thereby enabling high-frequency electric waves to be transmitted along the pipe 8, the lead wire 10 and the internal wall 12. Accordingly, protection against the leakage of electric waves is achieved by preventing the electric waves from being led out of the housing via the pipe 8 and the lead wire 10.

In such a construction, however, the internal configuration of the housing becomes complicated, since the hollow choke dampers 6 and 7 must be provided on internal walls of the heating chamber 1, through which the pipe 8 extends. This fact undesirably increases the cost of manufacture of the heating device. There is also another problem in that the radiating surface of the heating wire 9 inside the pipe 8 becomes short. As a result, the microwave heating acts extremely strongly on the dielectric pipe of the heater at locations a certain distance away from the internal walls of the heating chamber 1, in which openings for receiving the pipe 8 are formed.

The inventors of the instant application tried to arrange the choke dampers without any protrusion inside the heating chamber. In such an arrangement, upon application of high-frequency electric waves to the dielectric pipe of the heater, the exothermic conditions caused by the dielectric loss of the dielectric pipe were observed using a radiating thermometer or the like. As a result, a problem arose in that the microwave heating occasionally brought about partial high-temperature portions.

Furthermore, when the microwave heating was performed immediately after the heating by the heating wire 9, heat generated by the heating wire 9 increased the dielectric loss of the pipe 8 itself, thus causing partial abnormal heating. As a result, a problem occasionally arose in which the pipe 8 was melted or damaged or the heating wire 9 was cut off.

SUMMARY OF THE INVENTION

Accordingly, the present invention has been developed to substantially eliminate the above-described disadvantages inherent in the prior art high-frequency heating devices, and has as its essential object to provide an improved high-frequency heating device which can prevent electric waves from abnormally heating a dielectric by unifying the distribution of the electric waves at a location where the dielectric extends through a wall structure of a heating chamber.

Another important object of the present invention is to provide a high-frequency heating device of the above described type which is simple in construction and can be manufactured at a low cost.

In accomplishing these and other objects, a high-frequency heating device according to one preferred embodiment of the present invention comprises a housing, a wall structure formed in the housing and having a heating chamber and a heater compartment defined therein, and microwave supply means, fixedly mounted in the housing, for supplying microwaves into the heating chamber. The heater compartment is open towards the heating chamber in communication therewith. The wall structure for defining the heater compartment is made of microwave reflecting material.

The heating device according to the present invention is further internally provided with a heater sheathed by dielectric material accommodated in the heater compartment and extending through opposite side walls of the heater compartment, and electric field unifying means, disposed near the heater and securely mounted on at least one of the side walls of the heater compartment, for unifying an electric field on the heater.

Preferably, the electric field unifying means is made of one or more metallic rods having a length substantially equal to odd multiples of a quarter of a wavelength $\lambda$ of the microwaves to be led into the heating chamber. As a result, the electric field is uniformly distributed on the dielectric, thereby preventing the partial heating of the dielectric or any possible discharge accident.

Furthermore, the distance between the center of the metallic rod and that of the dielectric heater is rendered to be nearly equal to but less than approximately $\lambda/4$, thereby enabling the voltage distribution caused by the electric field on the dielectric to be minimized. Accordingly, the wave leakage from the heating chamber through the opening can be substantially reduced.

A single metallic rod may be extended through the heating chamber and opposite side walls of the heater compartment in parallel with the dielectric heater, thereby unifying the electric field on the dielectric heater and preventing food or the like from being brought into contact with the heater when it is taken in and out of the heating device.

In addition, a plurality of metallic rods may be securely mounted on at least one of opposite side walls of the heater compartment. As a result, since the electric field on the heater is further unified, an abnormal temperature rise caused by the microwaves can be prevented.

In another aspect of the present invention, there is provided a heating method employing microwave heating and heater heating by a dielectric heater and comprising the steps of performing the heater heating, prohibiting the microwave heating during a predetermined period of time after completion of the heater heating, and permitting the microwave heating upon lapse of the predetermined period.

The dielectric becomes high in temperature immediately after the dielectric heater has been charged with electricity. This fact causes the dielectric loss to become large. Accordingly, in the above-described novel method, the microwave heating is prohibited during the predetermined period after completion of the heater heating, thereby preventing an abnormal temperature rise of the heater, which may cause melting of the dielectric, damage of the heater or braking of a heating wire of the heater.

When the microwave heating is being prohibited, the lapse of time is being displayed on a display means. Accordingly, a user can know that the heating is normally being performed.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
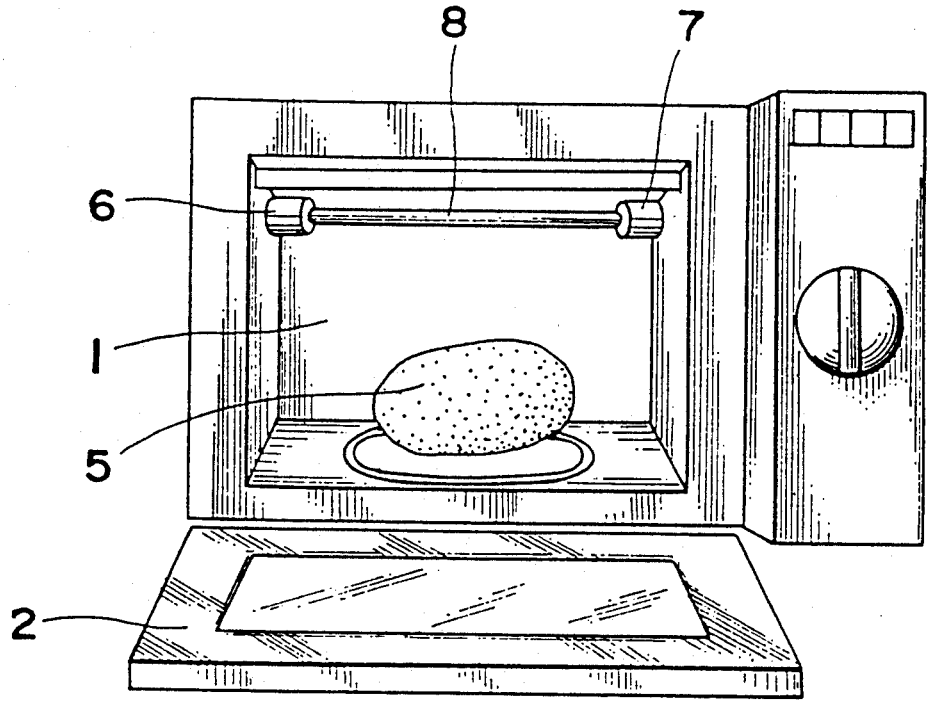
Fig. 1 PRIOR ART
FIG. 1 is a front elevational view of a conventional high-frequency heating device.
Figure 2:
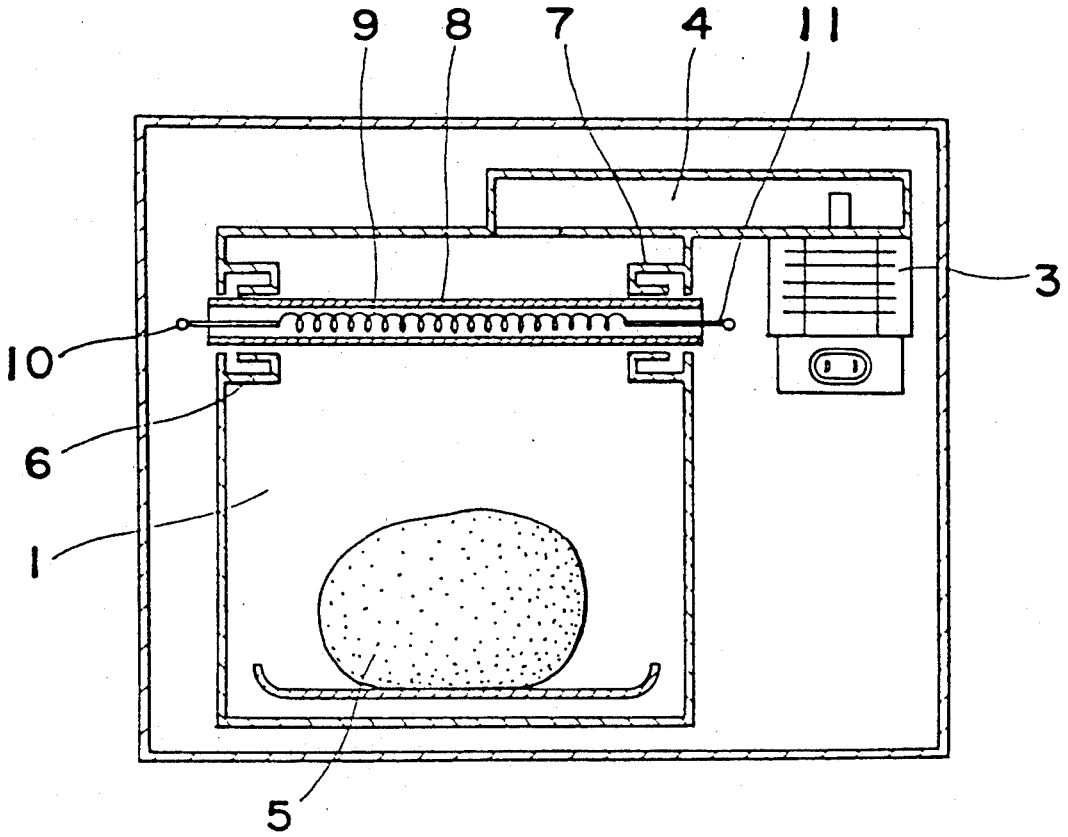
Fig. 2 PRIOR ART
FIG. 2 is a vertical sectional view of the device of FIG. 1.
Figure 3:
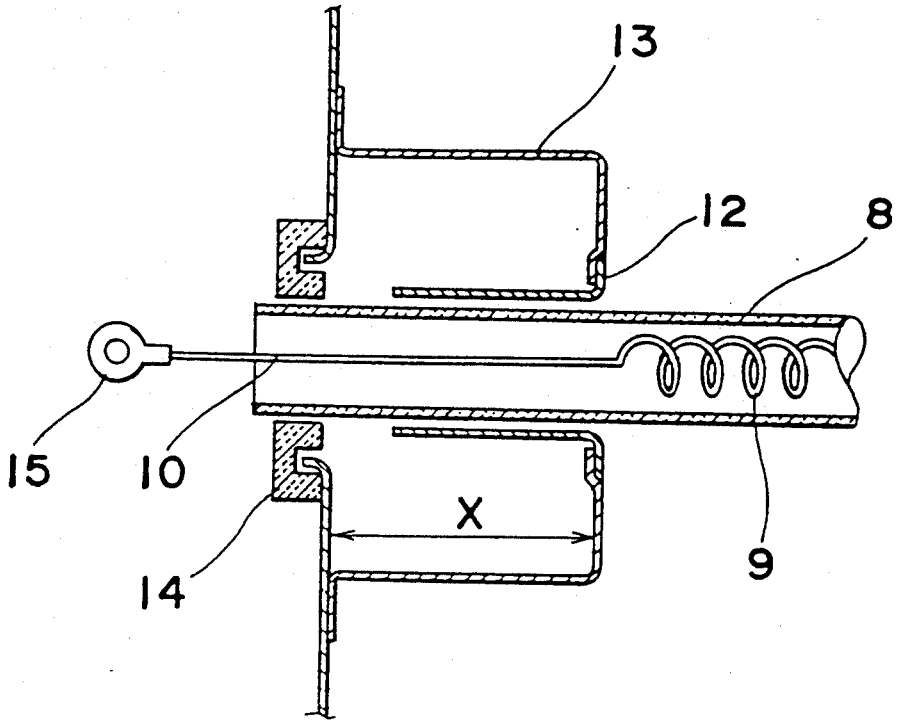
Fig. 3 PRIOR ART
FIG. 3 is a fragmentary vertical sectional view, on an enlarged scale, of a hollow choke damper provided in the device of FIG. 1.
Figure 4:
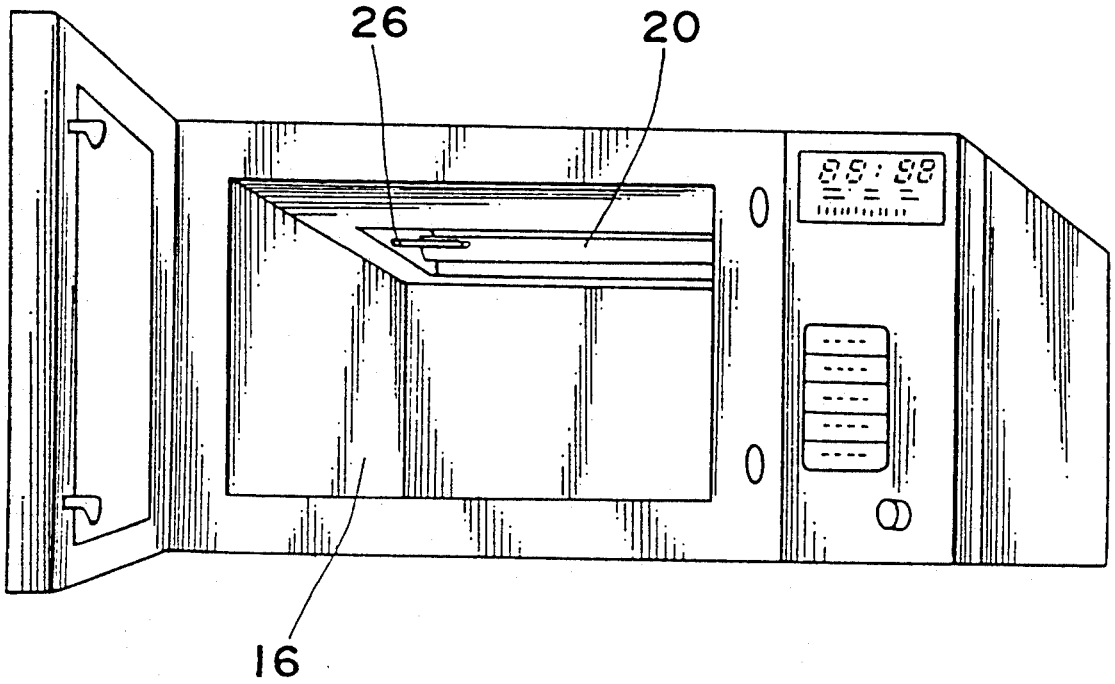
FIG. 4 is a perspective view of a high-frequency heating device according to one preferred embodiment of the present invention.
Figure 5:
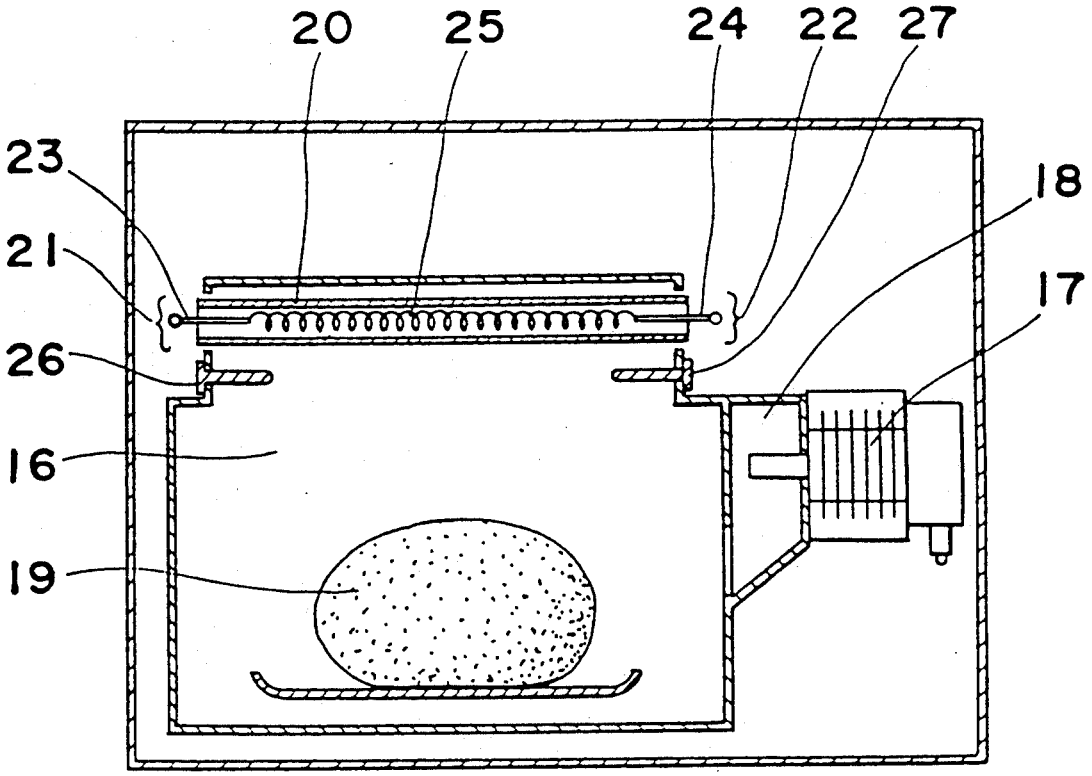
FIG. 5 is a vertical sectional view of the device of FIG. 4.

Referring now to the drawings, there is shown in FIGS. 4 and 5 a high-frequency heating device according to the present invention.

As shown in FIGS. 4 and 5, the high-frequency heating device accommodates a magnetron 17, fixedly mounted in a device housing, for emitting high-frequency electric waves and a pipe 20 made of heat-resistant dielectric such as quartz-glass or the like. The high-frequency electric waves emitted from the magnetron 17 are applied, via a waveguide 18, to food 19 or the like placed in a heating chamber 16. The pipe 20 extends through openings 21 and 22 formed in opposite side walls of the heating chamber 16. The pipe 20 accommodates a heating wire 25 having opposite ends connected to respective lead wires 23 and 24, which are lead out of the heating chamber 16 so that the heating wire 25 may be supplied with electricity via the lead wires 23 and 24.

Figure 6:
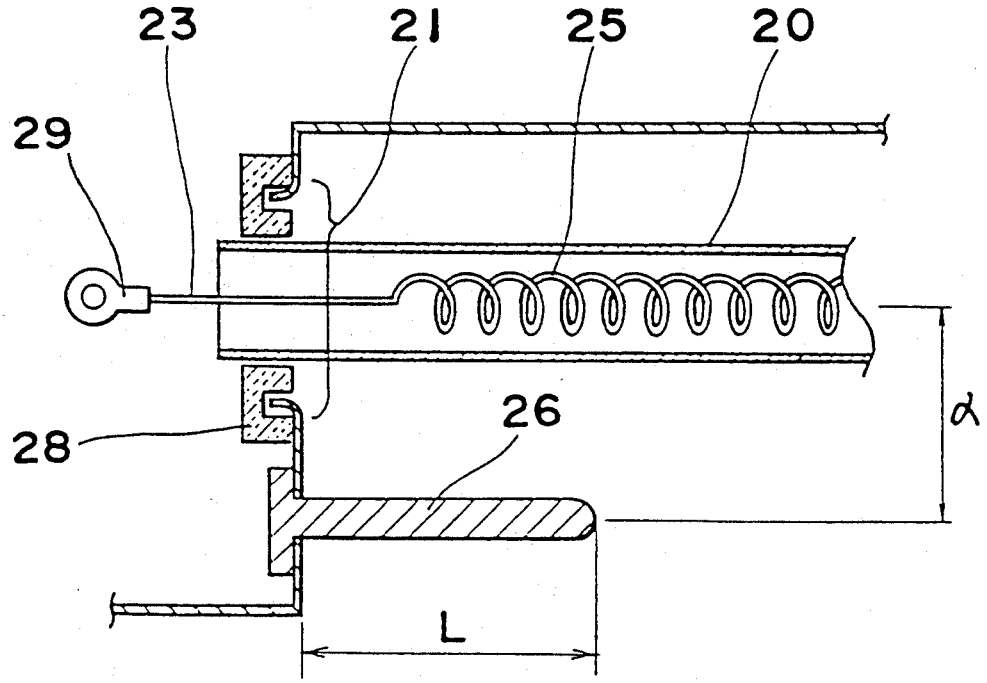
FIG. 6 is a fragmentary vertical sectional view, on an enlarged scale, of one end of a heater sheathed by dielectric material and provided in the device of FIG. 4.

FIG. 6 depicts the main portion of FIG. 5.

As shown in FIG. 6, the pipe 20 is supported at its opposite ends by respective insulators 28. One or more metallic rods 26 extend through the heating chamber 16 and the side walls of the heating chamber 16 in parallel with the pipe 20. Each of the metallic rods 26 has a length L greater than or approximately equal to a quarter of a wavelength $\lambda$ of the electric waves led into the heating chamber 16, thereby substantially uniformly distributing the electric field around the pipe 20, the heating wire 25 and the lead wires 23 in the longitudinal direction of the pipe 20. Furthermore, a distance $\alpha$ between the center of the pipe 20 and that of the metallic rod 26 is rendered to be approximately equal to a quarter-wavelength $\lambda/4$, thereby removing the voltage distribution in the electric field of the electric waves around the pipe 20, the heating wire 25 and the metallic rods 26. Accordingly, the leakage of electric waves from the heating chamber 16 through the openings 21 and 22 can be minimized.

A complicated structure, for example a hollow choke damper, is not required in this embodiment, and the wave sealing can be accomplished by a simple structure.

Moreover, since no portion of the pipe 20 is covered in the heating chamber 16, the effective length of the heating wire 25 can be lengthened, and therefore, the electric power per unit length of the heating wire 25 can be reduced. Accordingly, it is advantageous in that the life of the heating wire 25 become longer.

In addition, the pipe 20, immediately after the heating wire 25 has been charged with electricity, becomes high in temperature, thus causing the dielectric loss to become large. Under such conditions, even when the high-frequency heating is performed, the pipe 20 is not partially heated or melted because the electric field with respect to the pipe 20 is uniform and does not concentrate on part of the pipe 20.

Figure 11:
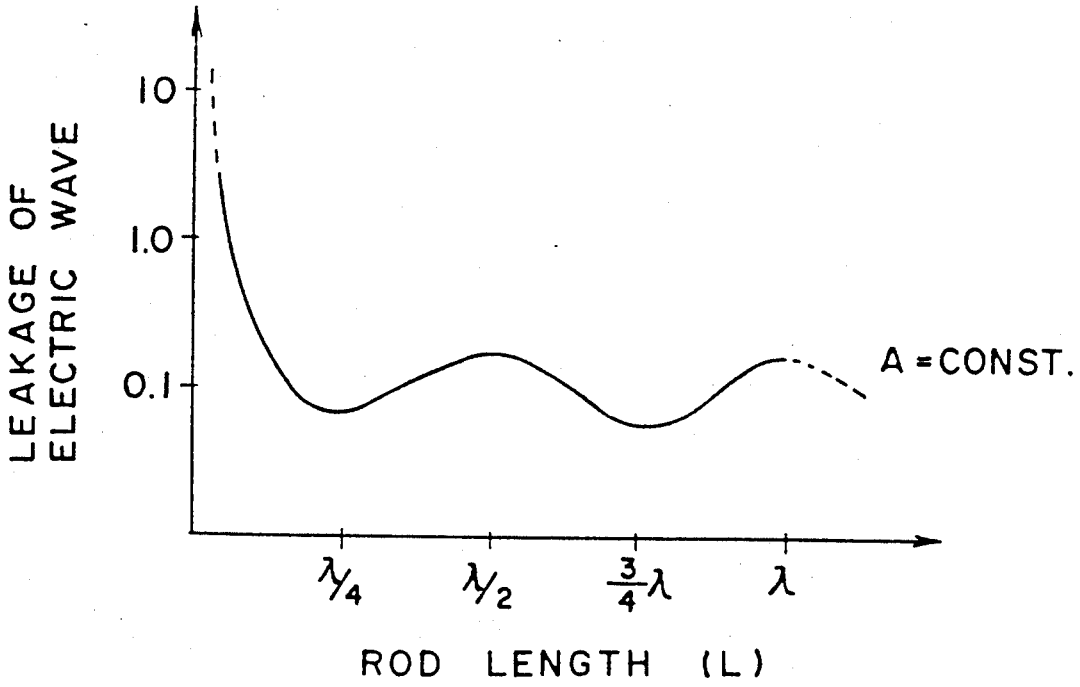
FIG. 11 is a graph indicative of the relationship between the length of a metallic rod provided in the device of FIG. 4 and the leakage of electric waves.
Figure 12:
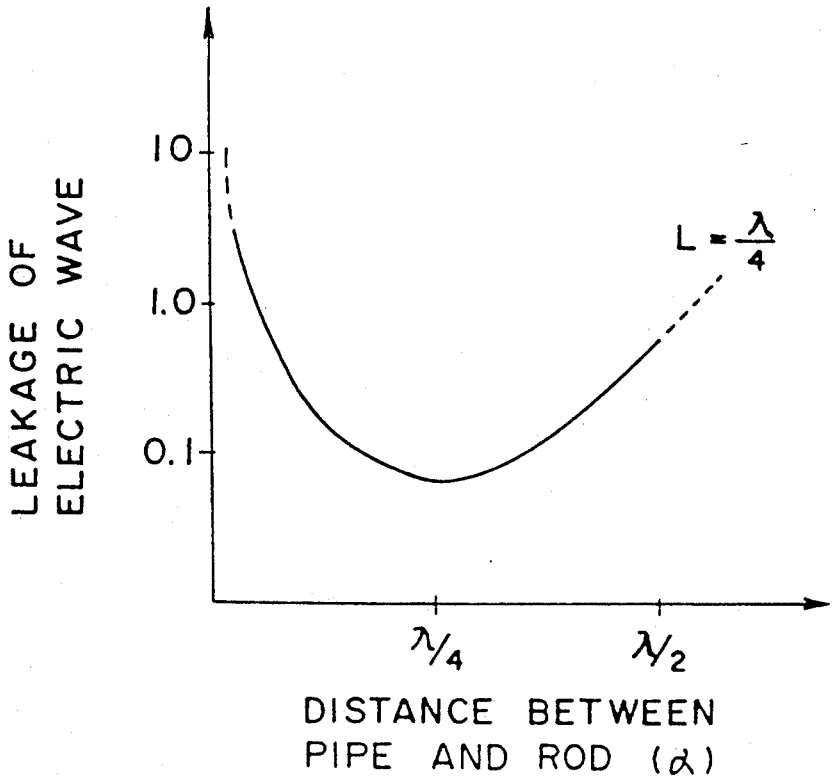
FIG. 12 is a graph indicative of the relationship between the distance from the dielectric heater to the metallic rod and the leakage of electric waves.

FIGS. 11 and 12 are graphs which were prepared on the basis of experiments made so far. The graph of FIG. 11 clearly indicates that the length of the metallic rod 26 should be substantially equal to odd multiples of a quarter-wavelength $\lambda/4$ whereas the graph of FIG. 12 clearly indicates that the distance between the center of the metallic rod 26 and that of the pipe 20 should be nearly equal to the quarter-wavelength $\lambda/4$.

Figure 7:
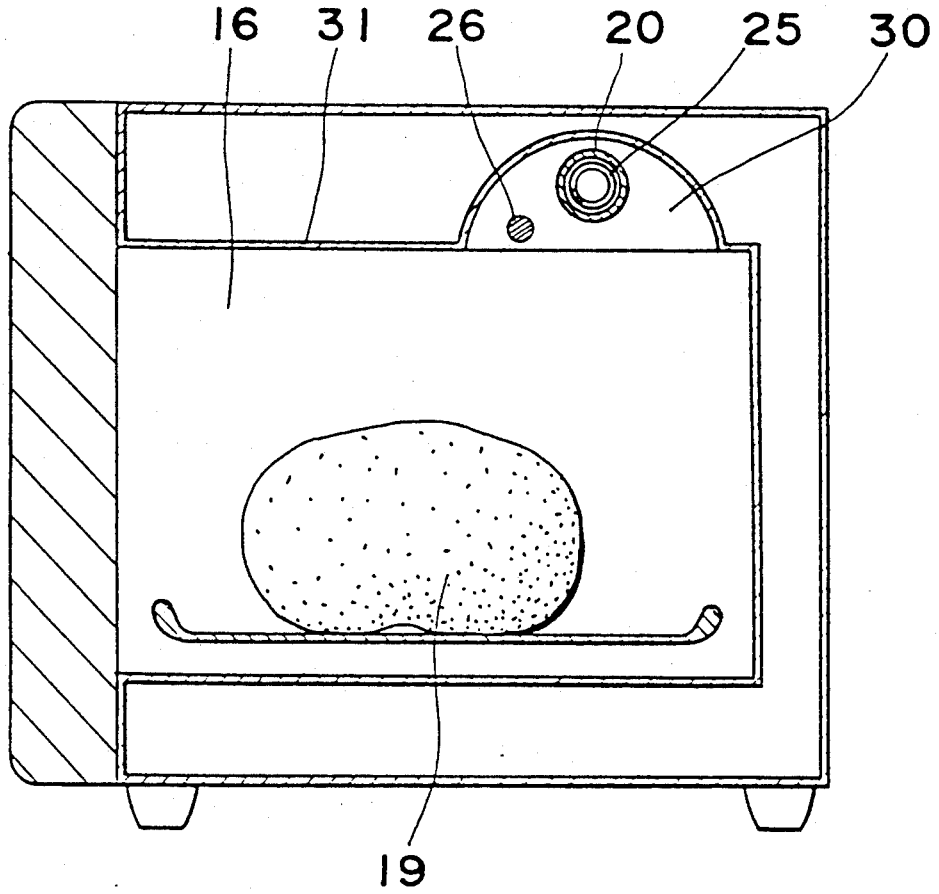
FIG. 7 is a vertical side sectional view of the device of FIG. 4.

As best shown in FIG. 7, the heating chamber 16 is defined by a generally box-shaped wall structure 31, which has a heater compartment 30 defined therein in such a manner that the heater compartment 30 may be open towards the heating chamber 16 in communication therewith. The pipe 20 and the metallic rods 26 are accommodated in the heater compartment 30.

Figure 8:
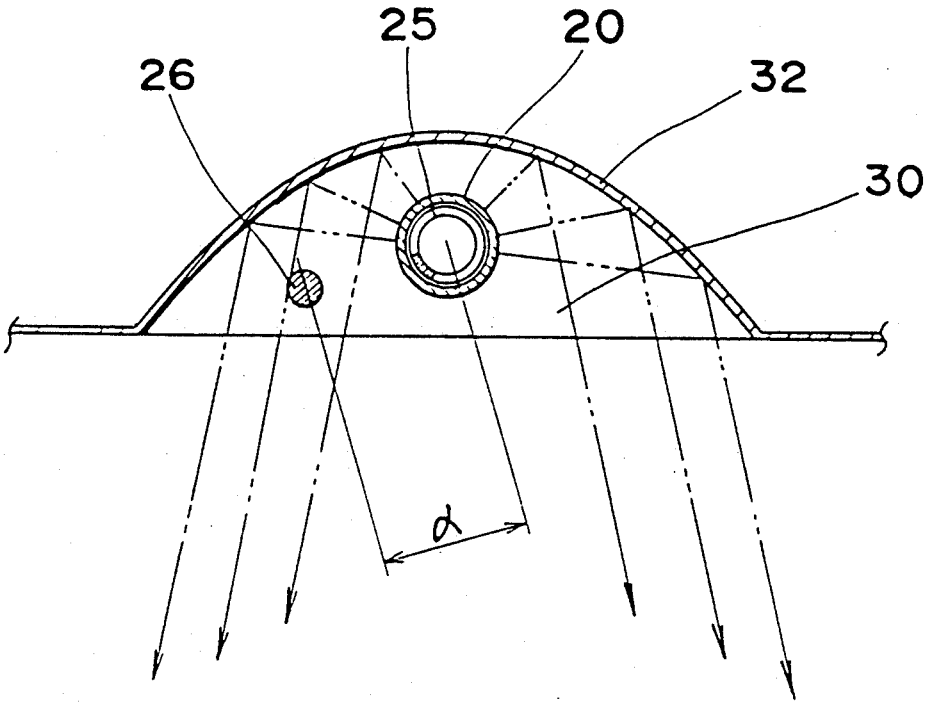
FIG. 8 is a fragmentary vertical side sectional view, on an enlarged scale, of a heater compartment formed in the device of FIG. 4.

FIG. 8 detailedly depicts the heater compartment 30. The heater compartment 30 is defined by a wall structure 32 of microwave reflecting material, which has a cross-section in the form of a parabola so that heat rays emitted from the heating wire 25 are effectively applied to food 19 or the like accommodated in the heating chamber 16. The pipe 20 is disposed in the vicinity of a focus of the parabola. Because of this, part of electric waves led into the heating chamber 16 is directed to the heater compartment 30. Such electric waves are liable to be concentrated on the pipe 20 disposed near the focus of the parabola. However, since the metallic rods 26 have a function of restricting electric waves from entering the heater compartment 30, the concentration of electric field on the focus of the parabola can also be alleviated.

Figure 9:
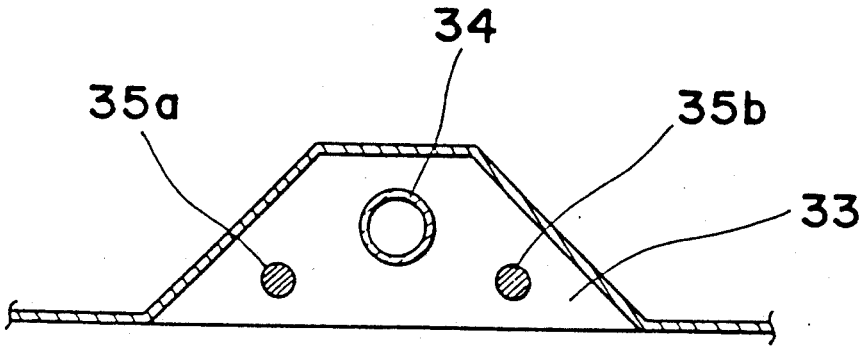
FIG. 9 is a view similar to FIG. 8 according to a modification thereof.
Figure 10:
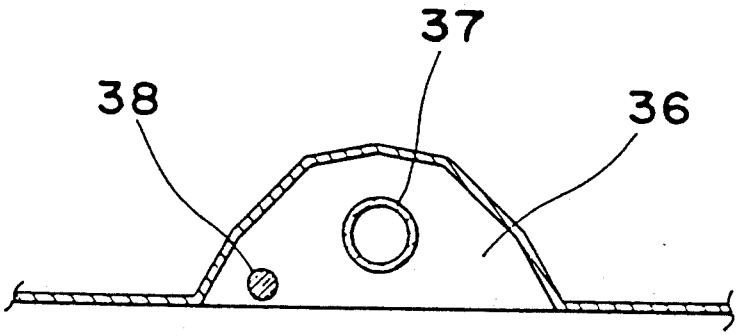
FIG. 10 is a view similar to FIG. 8 according to another modification thereof.

FIGS. 9 and 10 depict modifications 33 and 36 of the heater compartment, respectively. The wall structure of each of the heater compartments 33 and 36 is analogous in cross-section to that of the heater compartment 30 of FIG. 8 so that the desired results may be obtained. In these modifications also, metallic rods 35*a*, 35*b*, and 38 disposed in the vicinity of pipes 34 and 37, respectively, can prevent the electric field from being concentrated on the pipes 34 and 37.

Figure 13:
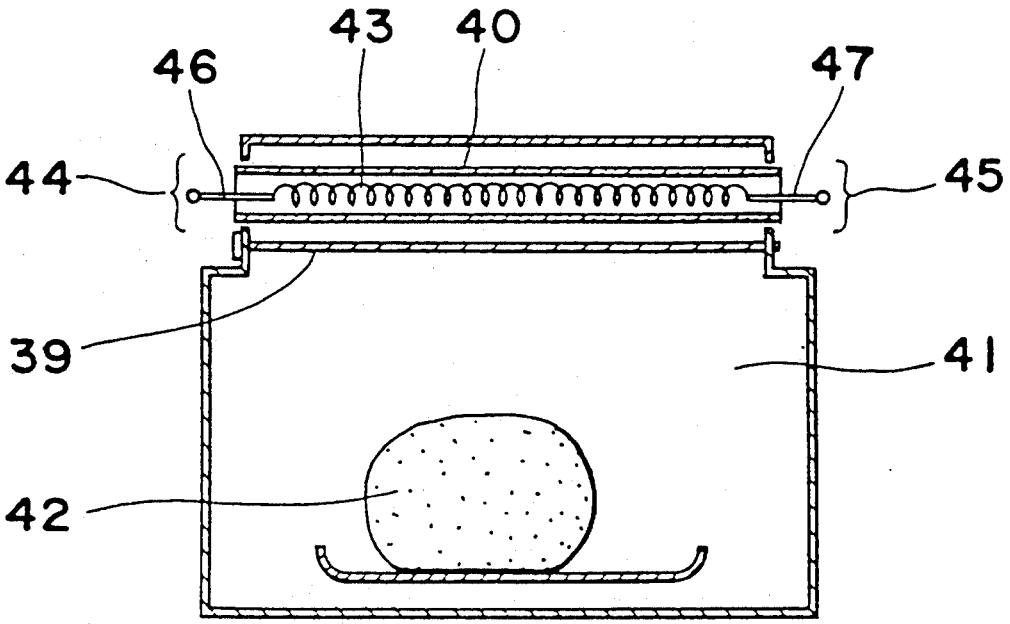
FIG. 13 is a vertical sectional view of a high-frequency heating device according to another embodiment of the present invention.

FIG. 13 depicts a high-frequency heating device according to another embodiment of the present invention.

The heating device of FIG. 13 accommodates a single metallic rod 39 extending through a heating chamber 41 and opposite side walls thereof in parallel with a pipe 40 of dielectric. As a result, the distribution of electric field is generally unified on the pipe 40, thereby preventing the partial heating or any possible discharge accident of the pipe 40. Furthermore, since the metallic rod 39 is disposed substantially below the pipe 40, food 42 or the like to be heated is hardly brought into contact with the pipe 40 even when the food 42 is taken in and out of the heating device. Accordingly, the metallic rod 39 can prevent the pipe 40 from being damaged. Even when the high-frequency heating is performed under the conditions in which the pipe 40 is high in temperature and the dielectric loss is large immediately after the heating wire 43 has been charged with electricity, the pipe 40 is never partially heated and melted because the electric field with respect thereto is uniform.

Figure 14:
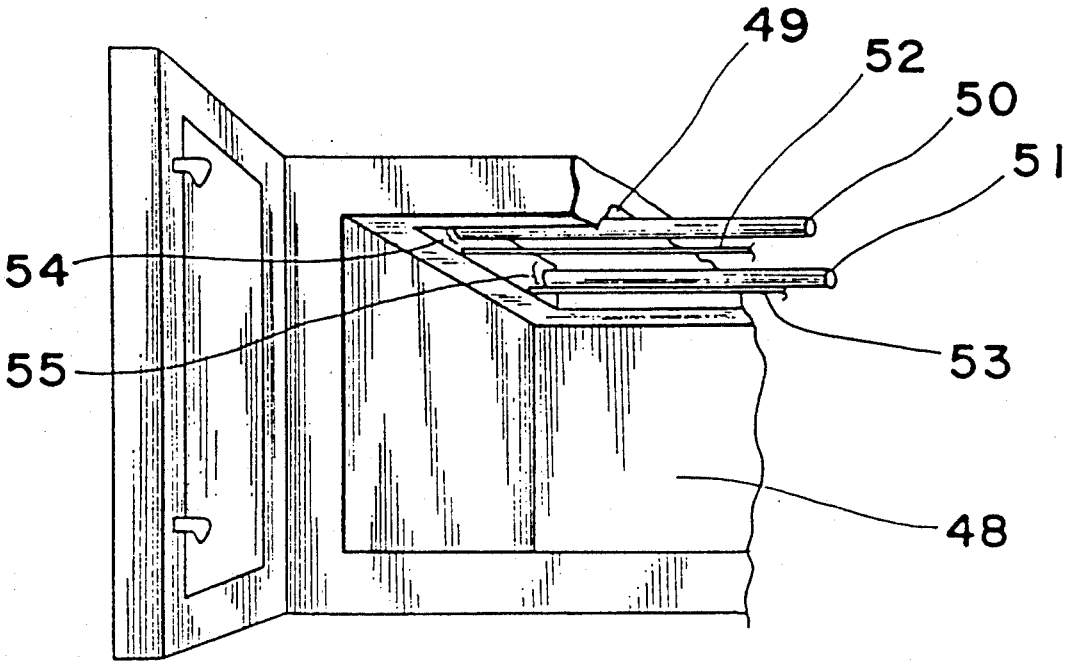
FIG. 14 is a fragmentary perspective view of a high-frequency heating device according to a further embodiment of the present invention.

FIG. 14 depicts a high-frequency heating device according to a further embodiment of the present invention.

As shown in FIG. 14, two pipes 50 and 51 of heat-resistant dielectric are accommodated in a heater compartment 49 formed in the ceiling of a heating chamber 48. The pipes 50 and 51 also accommodate respective heating wires. Two metallic rods 52 and 53 are disposed substantially below the pipes 50 and 51, respectively, in the heater compartment 49. As shown in this embodiment, even when plural sets of the pipe and the metallic rod are disposed in the heater compartment 49, the electric field does not concentrate on the pipes 50 and 51 so much. Furthermore, since the voltage distribution is almost removed in the electric field around openings 54 and 55 through which the pipes 50 and 51 extend, the wave leakage from these openings 54 and 55 can be minimized.

Figure 15:
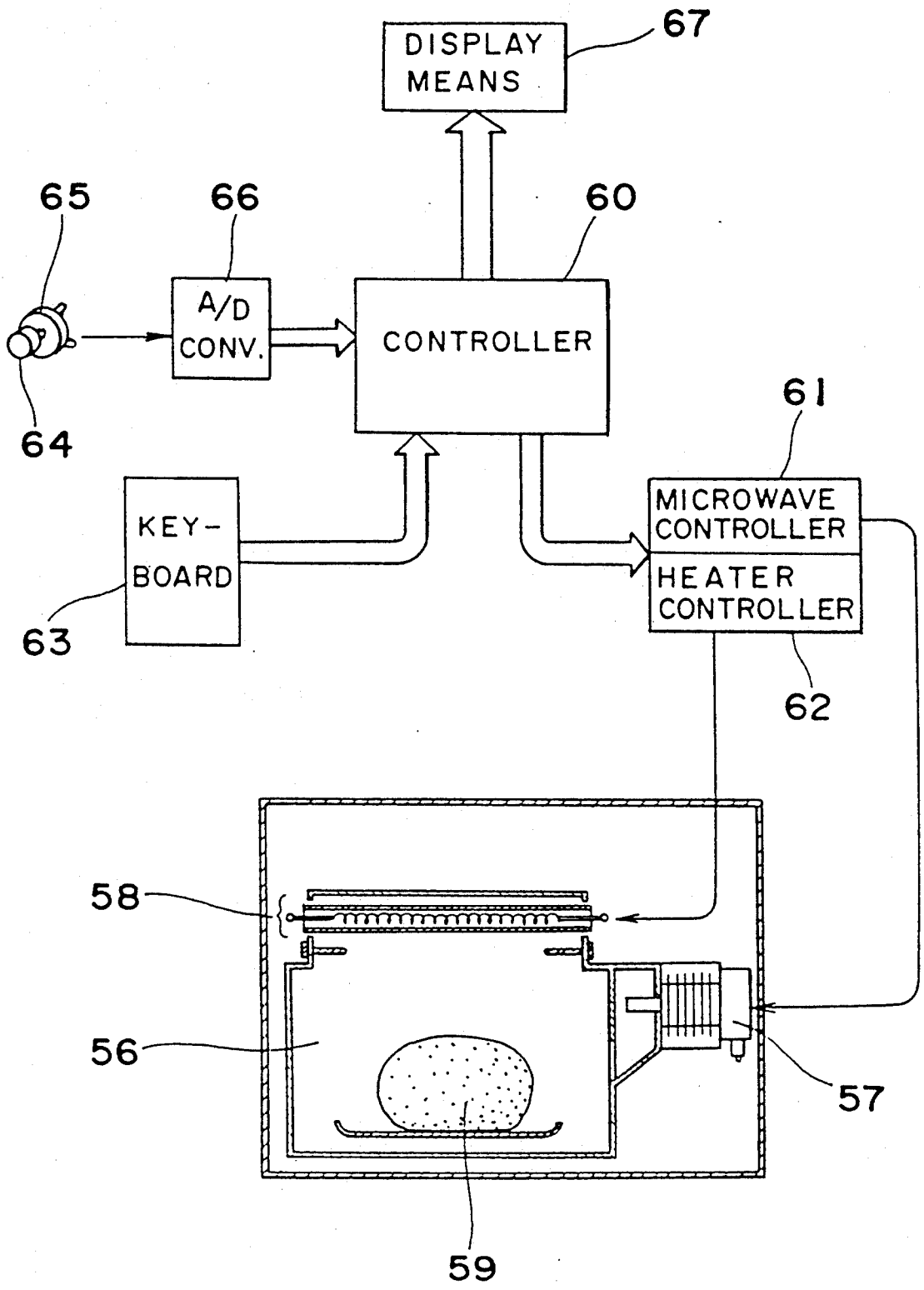
FIG. 15 is a block diagram of a control system according to the present invention.

FIG. 15 depicts a block diagram of a control system for controlling the high-frequency heating device according to the present invention.

The heating device is internally provided with a magnetron 57 as a microwave heating means and a pipe-shaped heater 58 for supplying heat energy to food 59 or the like placed in a heating chamber 56. The electric supply to these heating means is controlled by a main controller 60 via a microwave controller 61 and a heater controller 62, each of which includes switching means such as relays and driver means for driving the switching means.

Data for the heating are inputted into the main controller 60 using a keyboard 63 or a volume dial 64 coupled with a volume 65. An A/D converter 66 for reading the resistance of the volume 65 is interposed between the volume 65 and the main controller 60. The volume 65 may be constituted by a rotary encoder. The data inputted by the input means are initially stored in a RAM provided in the main controller 60 and are displayed on display means 67. The heating is controlled on the basis of these data.

Figure 16:
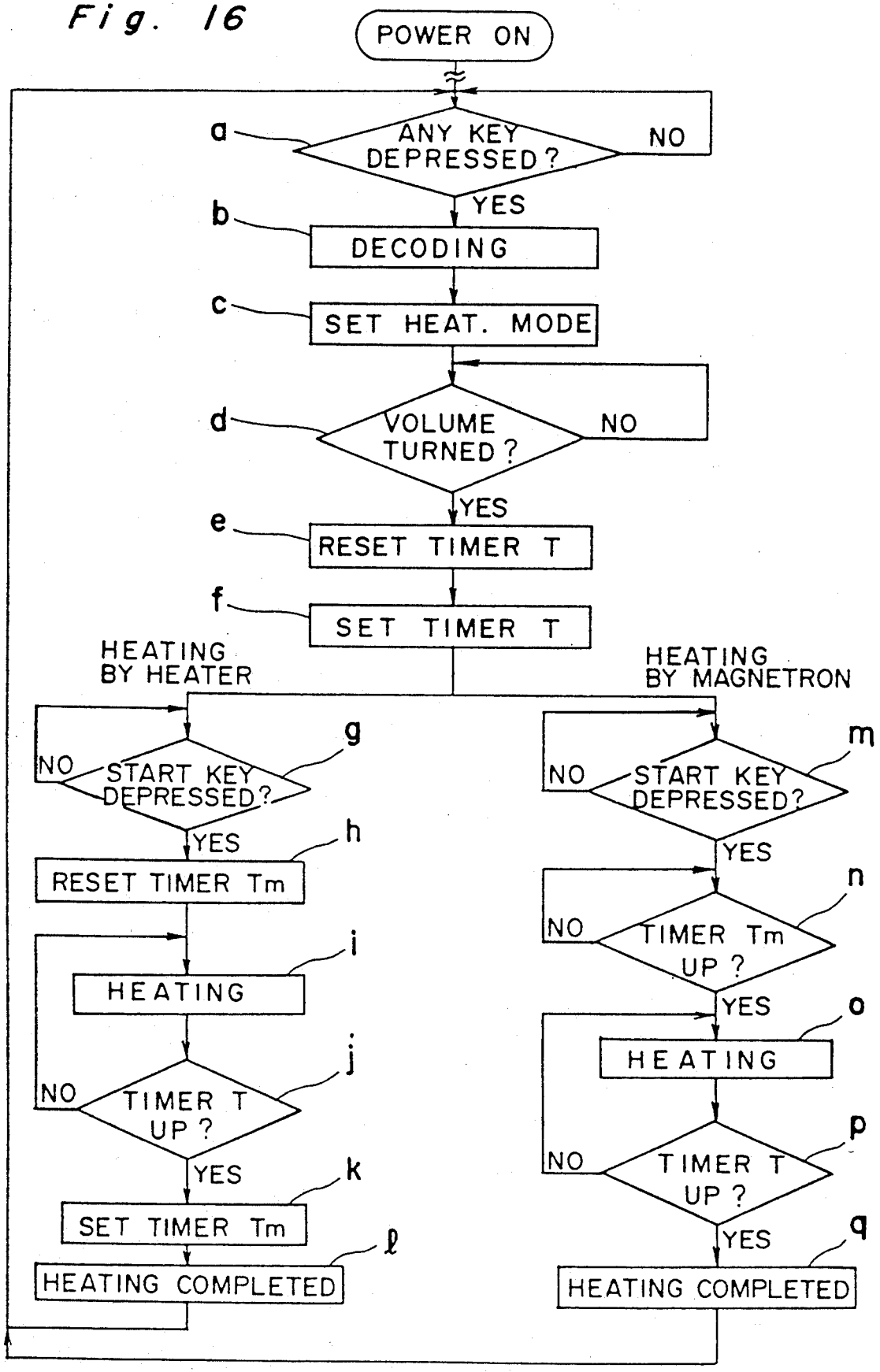
FIG. 16 is a flow chart indicative of a program to be performed by the control system of FIG. 15.

FIG. 16 is a flow chart indicative of a program for controlling the heating.

Prior to the operation of the keyboard 63, the main controller 60 causes the display means 67 to display only Os. When the keyboard 63 is operated at step (a), the main controller 60 decodes data inputted by the keyboard 63 at step (b) followed by step (c), at which a desired heating mode is set. In this event, the display means 67 displays the heating mode.

When the volume 65 is turned at step (d), an internal timer T is immediately reset at step (e). Then, the timer T is set at step (f) and the display means 67 displays the heating period set.

When the heater heating is designated and a start key is depressed at step (g), the main controller 60 starts the countdown of the timer T. Immediately thereafter, the main controller 60 resets an internal timer Tm at step (h) and sends the heater controller 62 a signal required for performing the heater heating at step (i). When the timer T is up at step (j), the timer Tm is set at step (k). In this way, the heater heating mode is completed at step (l), and the main controller 60 starts the countdown of the timer Tm.

On the other hand, when the microwave heating is designated and the start key is depressed at step (m), the main controller 60 starts the countdown of the timer T. After the timer Tm is up at step (n), the microwave heating is performed at step (o). When the timer T is up at step (p), the microwave heating is completed at step (q).

In the microwave heating mode, the supply of microwaves into the heating chamber 56 is prohibited until the timer Tm is up after the depression of the start key. During this period, although no microwaves are supplied into the heating chamber 56, the main controller 60 counts down the heating period displayed on the display means 67 and sends a control signal to the microwave controller 61 so that all other operations in the microwave heating mode may be performed.

According to the program control mentioned above, upon completion of the heater heating, no microwaves are applied to the dielectric heater 58 during the period set by the timer Tm. Accordingly, the temperature of the heater 58 becomes low until the timer Tm is up, thereby reducing the dielectric loss. Upon the lapse of the period set by the timer Tm, the dielectric loss is sufficiently low in the event of the application of the microwaves. Accordingly, it is possible not only to prevent the heater 58 from being partially heated or melted by the microwaves, but also to prevent any possible discharge accidents due to the breaking down of the heating wires in the heater 58. Preferably, the timer Tm is set to a period over 30 seconds.

These operations are naturally available in an automatic cooking program incorporated into the main controller 60. Furthermore, even when the cooking is performed by the microwave heating after the heater heating has manually been performed, the main controller 60 controls the control system so as not to send the microwave controller 61 a signal required for supplying the microwaves to the heating chamber 56 during the period set by the timer Tm after the completion of the heater heating. In other words, whether the heater heating is automatically or manually performed, no microwaves are supplied into the heating chamber 56 until the period set by the timer Tm elapses after the completion of the heater heating.

As is clear from the above description, since the high-frequency heating device according to the present invention is internally provided with a heater compartment having a very simple construction, the work necessary for positioning and fixedly mounting one or more metallic rods can be readily carried out to prevent the wave leakage. Accordingly, the time and labor required for such work can be reduced and the productivity becomes high.

Furthermore, since the electric field acting upon a dielectric heater and a heating wire is substantially uniform and the voltage distribution can be almost removed, the high-frequency absorption by the dielectric and the heating wire can be reduced. Accordingly, the deterioration of the dielectric and the heating wire with age can be restricted, thus making it possible to supply high-frequency heating devices having a long service life and being functionally stable.

The reduced high-frequency absorption by the dielectric improves the high-frequency absorption to an object to be heated, thereby enabling the time required for the cooking by the high-frequency heating to be shortened.

In addition, since no microwaves are applied until the dielectric loss of the dielectric heater becomes small, the deterioration of the heater with age can be restricted, and therefore, the service life thereof can be prolonged.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A heating method for an oven having a microwave source for generating microwave energy within a chamber and a thermal heating element sheathed by dielectric material for generating thermal energy within the chamber, the dielectric material being exposed to the microwave energy generated by the microwave source, said method comprising:

a step of thermal heating by causing the thermal heating element to generate thermal energy within the chamber, wherein a dielectric loss of the dielectric material increases as the temperature of the dielectric material increases in response to the thermal energy;

upon completion of the thermal heating, a step of prohibiting the microwave source from generating microwave energy within the chamber for a predetermined period of time, wherein the dielectric loss of the dielectric material decreases as the temperature of the dielectric material decreases in response to an absence of thermal energy; and upon the lapse of the predetermined period of time, a step of permitting the microwave source to generate microwave energy within the chamber.

2. A heating method as recited in claim 1, further comprising a step of displaying the lapse of time during the predetermined period of time.

3. A heating method for an oven having an input panel for allowing a user to input heating instructions, a microwave source for generating microwave energy within a chamber and a thermal heating element sheathed by dielectric material for generating thermal energy within the chamber, the dielectric material being exposed to the microwave energy generated by the microwave source, said method comprising:

in response to a thermal heating instruction input via the input panel, a step of thermal heating by causing the thermal heating element to generate thermal energy within the chamber, wherein a dielectric loss of the dielectric material increases as the temperature of the dielectric material increases in response to the thermal energy;

upon completion of the thermal heating, a step of activating a timer to measure a predetermined period of time;

in response to a microwave heating instruction input via the input panel, a step of determining whether the predetermined period of time measured by the timer has expired, a step of causing the microwave source to generate microwave energy within the chamber if the predetermined period of time has expired, and a step of prohibiting the microwave source from generating microwave energy within the chamber if the predetermined period of time measured by the timer has not expired so that the dielectric loss of the dielectric material decreases as the temperature of the dielectric material decreases in response to an absence of thermal energy, and then causing the microwave source to generate microwave energy within the chamber upon the lapse of the predetermined period of time measured by the timer.

4. A heating element as recited in claim 3, further comprising a step of displaying the lapse of time during the predetermined period of time measured by the timer.

* * * * *

UNITED STATES PATENT AND TRADEMARK OFFICE

CERTIFICATE OF CORRECTION

PATENT NO. : 5,189,274
DATED : February 23, 1993
INVENTOR(S) : Hideki YAMAGUCHI et al.

It is certified that error appears in the above-identified patent and that said Letters Patent is hereby corrected as shown below:

On the cover page, item [75], delete "Katsunori Furukawa, Kashihara,"

Signed and Sealed this

Twenty-fifth Day of January, 1994

*Attest:*

Bruce Lehman

BRUCE LEHMAN

*Attesting Officer*

*Commissioner of Patents and Trademarks*